US012742129B2

(12) United States Patent
Hayama

(10) Patent No.: US 12,742,129 B2
(45) Date of Patent: Sep. 22, 2026

(54) GREASE COMPOSITION

(71) Applicant: KYODO YUSHI CO., LTD., Fujisawa (JP)

(72) Inventor: Makoto Hayama, Fujisawa (JP)

(73) Assignee: KYODO YUSHI CO., LTD., Fujisawa (JP)

( * ) Notice: Subject to any disclaimer, the term of this patent is extended or adjusted under 35 U.S.C. 154(b) by 0 days.

(21) Appl. No.: 18/995,710

(22) PCT Filed: Sep. 7, 2023

(86) PCT No.: PCT/JP2023/032645
§ 371 (c)(1),
(2) Date: Jan. 16, 2025

(87) PCT Pub. No.: WO2024/053702
PCT Pub. Date: Mar. 14, 2024

(65) Prior Publication Data

US 2025/0215347 A1 Jul. 3, 2025

(30) Foreign Application Priority Data

Sep. 7, 2022 (JP) ..... 2022-142079

(51) Int. Cl.
*C10M 137/04* (2006.01)
*C10M 169/06* (2006.01)
*C10N 30/06* (2006.01)
*C10N 50/10* (2006.01)

(52) U.S. Cl.
CPC ..... *C10M 137/04* (2013.01); *C10M 169/06* (2013.01); *C10M 2207/1285* (2013.01); *C10M 2223/04* (2013.01); *C10M 2223/041* (2013.01); *C10M 2223/042* (2013.01); *C10M 2223/043* (2013.01); *C10N 2030/06* (2013.01); *C10N 2050/10* (2013.01)

(58) Field of Classification Search
CPC ..... C10M 137/04; C10M 169/06; C10M 2207/1285; C10M 2223/04; C10M 2223/041; C10M 2223/042; C10M 2223/043; C10N 2030/06; C10N 2050/10
See application file for complete search history.

(56) References Cited

U.S. PATENT DOCUMENTS

| | | | | |
|---|---|---|---|---|
| 2,820,766 | A * | 1/1958 | Elliott et al. | G04B 31/08 508/572 |
| 10,870,812 | B2 * | 12/2020 | Oshiumi | C10M 137/04 |
| 2012/0280169 | A1 * | 11/2012 | Kato | C10M 169/02 252/78.3 |
| 2016/0305488 | A1 | 10/2016 | Yoshihara et al. | |

FOREIGN PATENT DOCUMENTS

| | | | | |
|---|---|---|---|---|
| JP | H10259392 | A | | 9/1998 |
| JP | H11131084 | A | * | 5/1999 |
| JP | 4002637 | B2 | | 11/2007 |
| JP | 2013116991 | A | | 6/2013 |
| JP | 2018030970 | A | | 3/2018 |
| JP | 2018115235 | A | * | 7/2018 |
| JP | 2018119038 | A | | 8/2018 |
| JP | 2019172920 | A | | 10/2019 |
| JP | 2021138814 | A | | 9/2021 |
| WO | 2015083804 | A1 | | 6/2015 |

OTHER PUBLICATIONS

English-language machine translation of JP 2018-115235 (Year: 2018).*
English-language machine translation of JP 11-131084 A (Year: 1999).*
International Search Report (PCT/ISA/210) and Written Opinion (PCT/ISA/237) issued on Nov. 21, 2023, by the Japan Patent Office in corresponding International Application No. PCT/JP2023/032645, with English translation of the Search Report (11 pages).
Journal of Economic Maintenance Tribology, Special Issue, Lubrication Technology Inc., 2010, No. 543, pp. 12-13 with English translation (5 pages).

* cited by examiner

*Primary Examiner* — James C Goloboy
(74) *Attorney, Agent, or Firm* — Panitch Schwarze Belisario & Nadel LLP

(57) ABSTRACT

A grease composition includes (a) a compound having a phosphate ester moiety, (b) a base oil, and (c) a thickener. The last non-seizure load measured in accordance with ASTM D-2596 is 980 N or more.

3 Claims, No Drawings

GREASE COMPOSITION

CROSS-REFERENCE TO RELATED APPLICATIONS

This application is a Section 371 of International Application No. PCT/JP2023/032645, filed Sep. 7, 2023, which was published in the Japanese language on Mar. 14, 2024, under International Publication No. WO 2024/053702 A1, which claims priority under 35 U.S.C. § 119(b) to Japanese Application No. 2022-142079, filed Sep. 7, 2022, the disclosures of which are incorporated herein by reference in their entirety.

TECHNICAL FIELD

The present invention relates to a grease composition that is useful for applications requiring extreme-pressure (EP) properties.

BACKGROUND ART

It is common practice to include load-carrying additives in greases used under severe lubrication conditions. Such load-carrying additives include lubricity agents such as long-chain fatty acids; anti-wear agents and EP agents having sulfur, phosphorus, chlorine, etc., in their molecules, such as phosphate esters, metal dithiophosphate salts, organic ion compounds, and organic halogen compounds; and solid additives such as molybdenum disulfide, graphite, boron nitride, and polytetrafluoroethylene are known (Non-Patent Literature 1). Tricresyl phosphate is known as a representative phosphate ester type EP agent.

On the other hand, as uses other than EP agents for compounds having phosphate ester moieties, surfactants are typical (e.g., Patent Literature 1). In Patent Literature 1, it is described that surfactants such as polyoxyethylene alkyl ether phosphates, polyoxyalkylene alkyl ether phosphates, or salts thereof can be used as lubricity agents, but there is no description or suggestion that they can be used as anti-wear agents or EP agents.

In Patent Literature 2, it is described that titanate-based or aluminum-based coupling agents can be used to prevent low-temperature chattering in greases for electrical contacts, but there is no description or suggestion that the coupling agents can be used as EP agents.

Patent Literature 3 touts anti-wear properties with a combination of (A) base oil, (B) acidic phosphate esters, etc., and (C) isothiazoline compounds.

CITATION LIST

Patent Literatures

Patent Literature 1: Japanese Patent Application Publication No. 2013-116991

Patent Literature 2: Japanese Patent No. 4002637

Patent Literature 3: Japanese Patent Application Publication No. 2021-138814

Non Patent Literatures

Non-Patent Literature 1: Journal of Economic Maintenance Tribology, Special Issue, 2010, No. 543, Lubrication Technology Inc.

SUMMARY OF INVENTION

Problems to be Solved by the Invention

An object of the present invention is to provide a grease composition excellent in EP properties.

Means for Solution of the Problems

The present inventors have found that the above problems can be solved by including, in the grease composition, a compound having a phosphate ester moiety within its molecular structure, which has not been used as an EP agent until now. That is, the present invention provides the following inventions:

1. A grease composition comprising
   (a) a compound having a phosphate ester moiety,
   (b) a base oil; and
   (c) a thickener,
   wherein the last non-seizure load measured in accordance with ASTM D-2596 is 980 N or more.
2. The grease composition according to above 1, containing component (a) at 0.1 to 20% by mass based on a total mass of the composition.
3. The grease composition according to above 1 or 2, wherein component (a) is a compound represented by the following chemical formula (1):

$$[R^1-O-(A^1O)_n]_m-\overset{\overset{\displaystyle O}{\|}}{P}-(OM)_{3-m} \quad (1)$$

wherein in the formula, $R^1$ is an alkyl group having 1 to 24 carbon atoms or an aryl group which optionally has a substituent; $A^1O$ is an alkyleneoxy group having 2 to 4 carbon atoms; n is an integer of 0 to 30; m is an integer of 1 to 3; and M is a hydrogen atom, an alkali metal, a Group 2 metal, an ammonium group, or an organic ammonium group.
4. The grease composition according to above 1 or 2, wherein component (a) is at least one coupling agent (a2) having a phosphate ester moiety within the molecule, selected from the group consisting of (a2-1) silane coupling agents, (a2-2) titanium coupling agents, (a2-3) aluminum coupling agents, and (a2-4) zirconate coupling agents.
5. The grease composition according to above 1 or 2, wherein a weld point measured in accordance with ASTM D-2596 is 1960 N or more.
6. Use of the grease composition according to above 1 or 2 as an extreme-pressure wear-resistant grease for bearings, gears, automotive parts, industrial machinery parts, etc.

Advantageous Effects of Invention

According to the present invention, it is possible to provide a grease composition excellent in wear resistance, particularly in EP properties evaluated by ASTM D-2596.

DESCRIPTION OF EMBODIMENTS (a) Compound Having a Phosphate Ester Moiety

Component (a) of the present invention is a compound having a phosphate ester moiety within its molecule. Component (a) is a compound that can achieve a last non-seizure load of 980 N or more, as measured in accordance with ASTM D-2596, by incorporating it into a base grease.

As component (a), examples include (a1) compounds represented by the following Chemical Formula (1), and (a2) coupling agents containing a phosphate ester within the molecule.

(a1) the Compounds Represented by the Following Chemical Formula (1) are Currently Utilized as Anionic Surfactants in a Wide Range of Technical Fields.

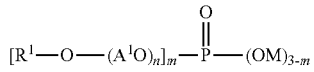

(1)

In the formula:

$R^1$ is a linear or branched alkyl group having 1 to 24 carbon atoms (preferably a linear or branched alkyl group having 3 to 18 carbon atoms), or an aryl group which optionally has a substituent (preferably an aryl group having substituents such as phenol, dodecylphenol, dinonylphenol, styrenated phenol, phenol derivatives, alkylbenzene, etc.).

$A^1O$ is an alkyleneoxy group having 2 to 4 carbon atoms, preferably an ethyleneoxy group or a 1,2-propyleneoxy group, more preferably an ethyleneoxy group.

n represents the number of moles of added alkyleneoxy groups and is an integer of 0 to 30. n is preferably 0 to 12. When n is 2 or more, the n units of $A^1O$ may be the same or different; if they are different, the addition form of $-(A^1O)_n-$ can be random addition, block addition, or alternating addition.

m is an integer of 1 to 3, preferably 1 or 2.

M is a hydrogen atom, an alkali metal, a Group 2 metal, an ammonium group, or an organic ammonium group. Na, Ca, ammonium group, or organic ammonium group is preferred.

Compounds of formula (1) are preferably monoesters or diesters.

More preferably, they are monoesters or diesters such that in formula (1):

$R^1$ is a linear or branched alkyl group having 3 to 18 carbon atoms, a linear or branched alkenyl group having 3 to 18 carbon atoms, or an aryl group having substituents such as phenol, dodecylphenol, dinonylphenol, styrenated phenol, phenol derivatives, alkylbenzene, etc., $A^1O$ is an ethyleneoxy group or a 1,2-propyleneoxy group, n is 0 to 12, m is 1 or 2, and M is Na, Ca, an ammonium group, or an organic ammonium group.

As anionic surfactants containing a phosphate ester moiety other than the compounds represented by formula (1) that can be used in the present invention, glycerin fatty acid esters, polyoxyalkylene alkyl ether phosphates, or salts thereof can be mentioned. Specific examples include trioxyethylene alkyl (12-15) ether phosphate, nonaoxyethylene alkyl (12-15) ether phosphate, trioxyethylene stearyl ether phosphate, tetraoxyethylene lauryl ether phosphate, isopropyl ether phosphate, butyl ether phosphate, isohexyl ether phosphate, alkyl (C6-C10) ether phosphate, dodecyl ether phosphate, lauryl ether phosphate, isotridecyl ether phosphate, alkyl (12-15) ether phosphate, monooxyethylene isohexyl ether phosphate, tetraoxyethylene alkyl (C6-C10) ether phosphate, dioxyethylene dodecyl ether phosphate, trioxyethylene isotridecyl ether phosphate, hexaoxyethylene isotridecyl ether phosphate, decaoxyethylene isotridecyl ether phosphate, dioxyethylene stearyl ether phosphate, hexaoxyethylene phenyl ether phosphate, dioxyethylene dodecyl phenyl ether phosphate, octaoxyethylene dinonylphenol ether phosphate, dodecaoxyethylene dinonylphenol ether phosphate, undecaoxyethylene styrenated phenol ether phosphate, undecaoxyethylene phenol derivative ether phosphate, sodium butyl ether phosphate, sodium tetraoxyethylene dodecyl ether phosphate, calcium hexaoxyethylene isotridecyl ether phosphate, hexaoxyethylene phenol ether phosphate, trioxyethylene isotridecyl ether phosphate (all manufactured by Toho Chemical Industry Co., Ltd., Phosphanol series), polyoxypropylene alkyl ether phosphate, polyoxybutylene alkyl ether phosphate, or salts thereof. Commercially available specific examples also include Disparlon DA-325, Disparlon DA-375, HIPLAAD ED152, and HIPLAAD ED152 manufactured by Kusumoto Chemicals, Ltd., and Hypermer KD23, Hypermer KD24, Crodafos 03A, and Crodafos 010A manufactured by Croda, and others.

As component (a1), polyoxyalkylene alkyl ether phosphates or salts thereof are preferred; polyoxyethylene alkyl ether phosphates or salts thereof are more preferred; trioxyethylene alkyl (12-15) ether phosphate, nonaoxyethylene alkyl (12-15) ether phosphate, trioxyethylene stearyl ether phosphate, and tetraoxyethylene lauryl ether phosphate are even more preferred.

(a2) Coupling Agents Having a Phosphate Ester Moiety within the Molecule

Component (a2) is preferably at least one selected from the group consisting of (a2-1) silane coupling agents, (a2-2) titanium coupling agents, (a2-3) aluminum coupling agents, and (a2-4) zirconate coupling agents.

Specific examples include bis [2-diphenolphosphinoethyl]methylsilylethyltriethoxysilane (manufactured by AZmax Co., Ltd., SIB1091.0), (2-diphenylphosphino) ethyldimethylethoxysilane (AZmax Co., Ltd., SID4557.5), 2-(diphenylphosphino) ethyltriethoxysilane (AZmax Co., Ltd., SID4558.0), (2-diethylphosphatoethyl) triethoxysilane (AZmax Co., Ltd., SID3412.0), 3-(trihydroxysilyl) propyl methylphosphonate, monosodium salt (AZmax Co., Ltd., SIT8378.5.0), tetraisopropyl bis (dioctyl phosphite) titanate (manufactured by Ajinomoto Co., Inc., PLENACT 41B), isopropyl tris (dioctyl pyrophosphate) titanate, diisopropyl bis (dioctyl pyrophosphate) titanate (Ajinomoto Co., Inc., PLENACT 338X), tetra (2,2-diallyloxymethyl-1-butyl) bis (ditridecyl) phosphite titanate (Ajinomoto Co., Inc., PLENACT KR55), tetraoctyl bis(ditridecyl phosphite) titanate (Ajinomoto Co., Inc., PLENACT KR46B), bis (dioctyl pyrophosphate) ethylene titanate (Ajinomoto Co., Inc., PLENACT KR238S), and others.

Among the compounds having a phosphate ester moiety used in the present invention, at least one selected from the group consisting of trioxyethylene alkyl (12-15) ether phosphate, nonaoxyethylene alkyl (12-15) ether phosphate, trioxyethylene stearyl ether phosphate, tetraoxyethylene lauryl ether phosphate, isopropyl tris (dioctyl pyrophosphate) titanate, and diisopropyl bis (dioctyl pyrophosphate) titanate is preferred.

The content of component (a) is preferably 0.1 to 20% by mass, more preferably 0.1 to 15% by mass, and even more preferably 0.5 to 5% by mass, based on the total mass of the composition. By including 0.1 to 20% by mass of component (a), a grease composition excellent in load-carrying capacity can be obtained.

(b) Base Oil

The base oil that can be used in the present invention is not particularly limited and may be mineral oil or synthetic oil. Specific examples include mineral oils [for example, paraffinic or naphthenic mineral oils], synthetic hydrocarbon oils [for example, poly-α-olefin (oil obtained by polymerizing linear α-olefins having 6 to 18 carbon atoms such as 1-decene and then hydrogenating), polybutene, alkylnaphthalene, alkylbenzene, ethylene-α-olefin co-oligomers], ester oils [for example, diesters, polyol esters], ether oils [for example, polyalkylene glycol, polyphenyl ether], fluorinated oils, silicone oils, ionic liquids, and others. The synthetic oils may also be so-called biomass oils produced from biological resources derived from animals and plants. For example, biomass ester oils synthesized from various fatty acids and alcohols derived from vegetable oils, or biomass hydrocarbon oils using vegetable oils such as palm oil, corn oil, soybean oil can also be used. The base oil may be used alone or in combination of two or more kinds. These base oils can be used individually or as various mixed oils.

As the base oil, mineral oil, synthetic hydrocarbon oil (especially poly-α-olefin), or mixtures thereof are preferred; mineral oil or poly-α-olefin is more preferred; mineral oil (especially paraffinic mineral oil) is most preferred.

The kinematic viscosity of the base oil at 40° C. is, for example, 30 to 500 $mm^2/s$, preferably 50 to 300 $mm^2/s$, more preferably 70 to 200 $mm^2/s$ (for example, 90 to 150 $mm^2/s$). The above kinematic viscosity is measured by a method in accordance with JIS K 2283.

The content of the base oil is, relative to the total mass of the grease composition, for example, 60 to 97% by mass, preferably 70 to 95% by mass.

(c) Thickener

The thickener used in the present invention is not particularly limited, as long as it is a thickener commonly used in grease compositions. Specific examples include metal soaps, complex metal soaps, urea thickeners, urethane thickeners, carbon black, bentonite, silica compounds, polytetrafluoroethylene (PTFE), and the like. Thickeners selected from the group consisting of metal soaps, complex metal soaps, urea thickeners, and silica (silicon dioxide) are preferred; metal soaps and urea compounds are more preferred.

Specific examples of metal soaps include aluminum soaps, calcium soaps, lithium soaps, sodium soaps, barium soaps, and the like. Lithium soaps are preferred. Lithium stearate soap and lithium 12-hydroxystearate soap are more preferred. Lithium 12-hydroxystearate soap is particularly preferred.

Specific examples of complex metal soaps include lithium complex soaps, calcium complex soaps (for example, in calcium sulfonate complexes, thickeners combining calcium sulfonate and calcium carbonate with calcium salts of higher or lower fatty acids and calcium salts of inorganic acids are used. Specifically, lithium complex soaps are complex soaps composed of lithium salts of 12-hydroxystearic acid and azelaic acid), aluminum complex soaps, and the like.

As urea thickeners, for example, diurea thickeners obtained by reacting aromatic diisocyanates with aromatic amines, aliphatic amines, cyclohexylamine, or mixtures of two or more of these can be mentioned. Such diurea thickeners can be represented by the following formula (2):

$$R^{10}\text{—NHCONH—}R^{20}\text{—NHCONH—}R^{30} \quad (2)$$

In the formula, $R^{10}$ and $R^{30}$ may be the same or different and are aromatic hydrocarbon groups having 6 to 15 carbon atoms, linear or branched alkyl groups having 5 to 20 carbon atoms, or cyclohexyl groups; $R^{20}$ is a divalent aromatic hydrocarbon group having 6 to 15 carbon atoms.

Specific examples of aromatic diisocyanates include tolylene diisocyanate, diphenylmethane diisocyanate, naphthalene diisocyanate, and the like. Specific examples of aromatic amines include p-toluidine, aniline, naphthylamine, and the like. Specific examples of aliphatic amines include octylamine, nonylamine, decylamine, undecylamine, dodecylamine, tridecylamine, tetradecylamine, pentadecylamine, hexadecylamine, heptadecylamine, octadecylamine, nonyldecylamine, eicosylamine, and the like.

As the diurea thickener, a thickener wherein $R^{10}$ and $R^{30}$ in formula (2) are linear alkyl groups having 8 carbon atoms, and $R^{20}$ is a group derived from diphenylmethane diisocyanate is preferred. This diurea thickener is a reaction product of octylamine and diphenylmethane diisocyanate.

Furthermore, as the diurea thickener, diurea thickeners comprising compounds wherein in formula (2), $R^{10}$ is a linear alkyl group having 18 carbon atoms, $R^{30}$ is a cyclohexyl group, and $R^{20}$ is a group derived from diphenylmethane diisocyanate; compounds where $R^{10}$ and $R^{30}$ are linear alkyl groups having 18 carbon atoms, and $R^{20}$ is a group derived from diphenylmethane diisocyanate; and compounds where $R^{10}$ and $R^{30}$ are cyclohexyl groups, and $R^{20}$ is a group derived from diphenylmethane diisocyanate are also preferred. This diurea thickener is a reaction product of octylamine and cyclohexylamine with diphenylmethane diisocyanate.

The most preferred diurea thickener is one wherein $R^{10}$ and $R^{30}$ in formula (2) are linear alkyl groups having 8 carbon atoms, and $R^{20}$ is a group derived from diphenylmethane diisocyanate.

As for silica (silicon dioxide), those having an average primary particle diameter of preferably 0.1 μm or less, more preferably 0.05 μm or less, are desirable. The penetration of the grease composition of the present invention is preferably 100 to 440. The content of the thickener in the composition of the present invention is an amount necessary to obtain this penetration. Specifically, it is preferably 3 to 30% by mass, more preferably 5 to 25% by mass, relative to the entire grease composition. More preferably, the penetration is 150 to 360. Note that the term "penetration" in this specification means the 60-stroke worked penetration measured in accordance with JIS K2220 7.

The grease composition of the present invention has a last non-seizure load (L.N.S.L.) defined in ASTM D-2596 of 980 N or more. This corresponds to a high load of 7 GPa in terms of contact pressure, which is a severe condition comparable to rolling contact in hybrid bearings of metal and ceramic or rolling four-ball test conditions. The larger the value of the last non-seizure load, the better the EP properties. In this test, the last non-seizure load (L.N.S.L.) is preferably 1236 N or more from the viewpoint of EP performance, more preferably 1569 N or more. The L.N.S.L. indicates the limit load at which seizure occurs due to the breaking of the film under load and direct contact between steel balls.

It is preferable that the grease composition of the present invention has a weld point (W.P.) defined in ASTM D-2596 of 1960 N or more. This is the criterion required for robots and gear apparatuses. The larger the value of the weld point (W.P.), the better the EP properties. In JIS K2220, it is stipulated that the weld point (W.P.) in this test should be 2450 N or more for load-resistant greases, and from the viewpoint of EP properties, 2450 N or more is preferred, and 3089 N or more is more preferred. The W.P. indicates the load at which the steel balls fuse together and become integrated due to the frictional heat generated by sliding between the steel balls.

It is preferable that the grease composition of the present invention has an OK value of 900 N or more. This corresponds to a high load of 4.5 GPa in terms of contact pressure, which exceeds the maximum contact pressure of 3.5 GPa in constant velocity joints (CVJ), and corresponds to rolling-sliding test conditions or rolling conditions of crank pins for motorcycles. The larger the OK value, the better the EP properties. From the viewpoint of EP properties, 1000 N or more is preferred, and 1100 N or more is more preferred. Note that the OK value indicates the load immediately before seizure in the SRV step-up test. The SRV test will be described later.

In this specification, the EP properties at high speed are evaluated by the high-speed four-ball load-carrying capacity test (Shell four-ball test), and the EP properties at low speed are evaluated by the SRV test. The L.N.S.L. and W.P. measured by the Shell four-ball test mainly evaluate wear due to rotational motion, point contact, and sliding friction, while the OK value measured by the SRV test mainly evaluates wear EP properties due to reciprocating motion, surface contact, and sliding friction. Showing excellent results in multiple motion modes, PV conditions, and parameters means that EP properties can be exhibited at various levels.

[Other Additives]

The grease composition of the present invention may further contain other additives as needed. Specific examples of other additives include antioxidants (e.g., phenolic types, amine types), extreme-pressure agents (e.g., zinc dithiocarbamates, zinc dithiophosphates, organic molybdenum compounds), rust inhibitors (e.g., carboxylic acid types such as zinc naphthenate; sulfonic acid types such as Zn sulfonate, Ca sulfonate), viscosity index improvers, dispersants, and combinations thereof. However, it is preferred that it does not contain isothiazolin-type compounds such as 2-methyl-4-isothiazolin-3-one, 2-methyl-4,5-trimethylene-4-isothiazolin-3-one, 5-chloro-2-methyl-4-isothiazolin-3-one, 2-n-octylisothiazolin-3-one, 4,5-dichloro-2-n-octylisothiazolin-3-one, 1,2-benzisothiazolin-3-one, N-n-butyl-1,2-benzisothiazolin-3-one, or combinations thereof.

When other additives are incorporated into the grease composition, their content varies depending on the type but is, for example, 0.1 to 10% by mass, preferably 0.5 to 5% by mass, relative to the total mass of the grease composition.

The grease composition of the present invention is particularly useful as an extreme-pressure wear-resistant grease for bearings, gears, automotive parts, industrial machinery parts, and the like, used under severe lubrication conditions.

Examples

1. Preparation of Grease Compositions (1) Preparation of Base Grease with Thickener Being Aliphatic Diurea In a base oil (mineral oil with a kinematic viscosity at 40° C. of 100 $mm^2/s$), 1 mol of 4',4-diphenylmethane diisocyanate and 2 mol of octadecylamine were reacted; after heating and cooling, the mixture was kneaded with a three-roll mill to obtain a base grease. The proportion of the thickener in the base grease is 7% by mass.

(2) Preparation of Base Grease with Thickener being Lithium 12-Hydroxystearate

To a base oil (mineral oil with a kinematic viscosity at 40° C. of 100 $mm^2/s$), 12-hydroxystearic acid was added, and after heating, an aqueous solution of lithium hydroxide was added to carry out a saponification reaction. After completion of the reaction, heating was performed to a specified temperature, followed by cooling, and kneading with a three-roll mill to obtain a base grease.

(3) Preparation of Grease Compositions

To the base greases obtained above, the additives listed in Table 1 were blended at the ratios shown in Table 2 (the numbers in the table are mass % based on the total mass of the composition); additional base oil was added to achieve the worked penetration shown in Table 2, and dispersion was carried out with a three-roll mill to obtain grease compositions of the Examples and Comparative Examples having the worked penetration shown in Table 2.

TABLE 1

(a) Compounds Having Phosphate Ester Moieties

| | Chemical Name | Manufacturer | Product Name/Item |
|---|---|---|---|
| a1 | Trioxyethylene Alkyl (12-15) Ether Phosphate*1 | Toho Chemical Industry Co., Ltd. | Phosphanol RS-410 |
| a1 | Nonaoxyethylene Alkyl (12-15) Ether Phosphate*1 | Toho Chemical Industry Co., Ltd. | Phosphanol RS-710 |
| a1 | Trioxyethylene Stearyl Ether Phosphate | Toho Chemical Industry Co., Ltd. | Phosphanol RL-310 |
| a1 | Tetraoxyethylene Lauryl Ether Phosphate | Toho Chemical Industry Co., Ltd. | Phosphanol RD-510Y |
| a2 | Isopropyl Tris(Dioctyl Pyrophosphate) Titanate | Ajinomoto Co., Inc. | PLENACT 38S |
| a2 | Diisopropyl Bis(Dioctyl Pyrophosphate) Titanate | Ajinomoto Co., Inc. | PLENACT 338X |
| a1 | Phosphate Ester | Kusumoto Chemicals, Ltd. | Disparlon DA-375 |
| a1 | Polyoxyethylene Lauryl Ether Phosphate Metal Salt | KATSUTA KAKO CO., LTD. | OR-40 |
| Reference | Phosphate Ester CNF | Oji Holdings Corporation | CNF |
| Reference | Isopropyl Tri(N-aminoethyl-aminoethyl) Titanate | Ajinomoto Co., Inc. | PLENACT KR44 |
| Reference | Acetoalkoxy Aluminum Isopropylate | Ajinomoto Co., Inc. | PLENACT AL-M |
| Reference | Polyoxyethylene Alkyl Ether | Sanyo Chemical Industries, Ltd. | EMULMIN 40 |
| Reference | Polyether Acid, Polyamine | Kusumoto Chemicals, Ltd. | Disparlon DA-234 |
| Reference | Tricresyl Phosphate | | TCP |

*1The numbers in parentheses following "Alkyl" indicate the number of carbon atoms in the alkyl group.

2. Evaluation of Grease Compositions

The EP properties of the grease compositions prepared above were evaluated by the high-speed four-ball load-carrying capacity test (Shell four-ball test) and the SRV test.

(1) High-Speed Four-Ball Load-Carrying Capacity Test (Shell Four-Ball Test)

In accordance with ASTM D-2596, L.N.S.L. and W.P. were measured. The sliding speed was 0.56 mm/s. This test evaluates EP properties due to rotational motion, point contact, and sliding friction.

(2) SRV Test

A steel ball (SUJ-2) with a diameter of 10 mm was pressed perpendicularly onto a disk with a diameter of 24 mm and a thickness of 7.855 mm, and at a test temperature of 25° C., reciprocated horizontally at a frequency of 15 Hz, an amplitude of 1 mm, and a speed of 0.03 mm/s. The load applied to the disk was increased to 1200 N at 100 N/min, and the friction coefficient at the specified load was measured. A sudden increase in the friction coefficient (0.25 or more) was regarded as seizure, and the load immediately before was taken as the OK value (maximum load without seizure). This test evaluates wear due to reciprocating motion, point contact, and sliding friction.

(3) Worked Penetration

The worked penetration was measured in accordance with JIS K2220 5.7.

EVALUATION CRITERIA

L.N.S.L.: 980 N or more: ○; less than 980 N: x

W.P.: 1960 N or more: ○; less than 1960 N: x

OK Value: 900 N or more: ○; less than 900 N: x

The results are shown in Table 2.

TABLE 2

| | | Composition | Comparative Example 1 | Comparative Example 2 | Example 1 | Example 2 | Example 3 | Example 4 | Example 5 | Example 6 | Example 7 | Example 8 |
|---|---|---|---|---|---|---|---|---|---|---|---|---|
| (a) Compound Having Phosphate Ester Moiety | (a1) | Trioxyethylene Alkyl (12-15) Ether Phosphate | — | 0.05% | 1.0% | 12.0% | 20.0% | — | — | — | — | — |
| | (a1) | Nonaoxyethylene Alkyl (12-15) Ether Phosphate | — | — | — | — | — | 3.0% | — | — | — | — |
| | (a1) | Trioxyethylene Stearyl Ether Phosphate | — | — | — | — | — | — | 3.0% | — | — | — |
| | (a1) | Tetraoxyethylene Lauryl Ether Phosphate | — | — | — | — | — | — | — | 3.0% | — | — |
| | (a2) | Isopropyl Tris(Dioctyl Pyrophosphate) Titanate | — | — | — | — | — | — | — | — | 3.0% | |
| | (a2) | Diisopropyl Bis(Dioctyl Pyrophosphate) Titanate | — | — | — | — | — | — | — | — | — | 3.0% |
| | (a1) | Phosphate Ester | — | — | — | — | — | — | — | — | — | — |
| | (a1) | Polyoxyethylene Lauryl Ether Phosphate Metal Salt | — | — | — | — | — | — | — | — | — | — |
| | Reference | Phosphate Ester-modified Cellulose Nanofiber | — | — | — | — | — | — | — | — | — | — |
| | Reference | Isopropyl Tri(N-aminoethyl-aminoethyl) Titanate | — | — | — | — | — | — | — | — | — | — |
| | Reference | Acetoalkoxy Aluminum Isopropylate | — | — | — | — | — | — | — | — | — | — |
| | Reference | Polyoxyethylene Alkyl Ether | — | — | — | — | — | — | — | — | — | — |
| | Reference | Polyether Acid, Polyamine | — | — | — | — | — | — | — | — | — | — |
| | Reference | Tricresyl Phosphate | — | — | — | — | — | — | — | — | — | — |
| (b) Base Oil | Mineral Oil | | 93.0% | 92.95% | 92.1% | 81.8% | 74.4% | 90.2% | 90.2% | 90.2% | 91.2% | 91.2% |
| (c) Thickener | Aliphatic Urea Thickener | | 7.0% | 7.0% | 6.9% | 6.2% | 5.6% | 6.8% | 6.8% | 6.8% | — | — |
| | Lithium 12-Hydroxystearate | | — | — | — | — | — | — | — | — | 5.8% | 5.8% |
| Evaluation | Shell ball Test | Last Non-seizure Load (L.N.S.L), N | 392 | 480 | 1961 | 1961 | 1961 | 1961 | 1961 | 1961 | 1568 | 1568 |
| | | Four-Evaluation of Last Non-seizure Load (L.N.S.L) | x | x | ○ | ○ | ○ | ○ | ○ | ○ | ○ | ○ |
| | | Weld Point (W.P.), N | 1236 | 2450 | 2452 | 3923 | 3923 | 2452 | 2452 | 2452 | 1960 | 1960 |
| | | Evaluation of Weld Point (W.P.) | x | ○ | ○ | ○ | ○ | ○ | ○ | ○ | ○ | ○ |
| | SRV Test | OK Value, N | 300 | 500 | 1000 | 1200 | 1200 | 900 | 1000 | 1200 | — | — |
| | | Evaluation of OK Value | x | x | ○ | ○ | ○ | ○ | ○ | ○ | — | — |
| | Worked Penetratio | Worked Penetration | 280 | 290 | 351 | 320 | 372 | 353 | 288 | 335 | — | — |
| | | Evaluation of Worked Penetration | ○ | ○ | ○ | ○ | ○ | ○ | ○ | ○ | — | — |

| | | Composition | Example 9 | Example 10 | Example 11 | Comparative Example 3 | Comparative Example 4 | Comparative Example 5 | Comparative Example 6 | Comparative Example 7 | Comparative Example 8 |
|---|---|---|---|---|---|---|---|---|---|---|---|
| (a) Compound Having Phosphate Ester Moiety | (a1) | Trioxyethylene Alkyl (12-15) Ether Phosphate | — | — | — | — | — | — | — | — | — |
| | (a1) | Nonaoxyethylene Alkyl (12-15) Ether Phosphate | — | — | — | — | — | — | — | — | — |
| | (a1) | Trioxyethylene Stearyl Ether Phosphate | — | — | — | — | — | — | — | — | — |
| | (a1) | Tetraoxyethylene Lauryl Ether Phosphate | — | — | — | — | — | — | — | — | — |
| | (a2) | Isopropyl Tris(Dioctyl Pyrophosphate) Titanate | — | — | — | — | — | — | — | — | — |
| | (a2) | Diisopropyl Bis(Dioctyl Pyrophosphate) Titanate | 3.0% | — | — | — | — | — | — | — | — |
| | (a1) | Phosphate Ester | — | 3.0% | — | — | — | — | — | — | — |
| | (a1) | Polyoxyethylene Lauryl Ether Phosphate Metal Salt | — | — | 3.0% | — | — | — | — | — | — |
| | Reference | Phosphate Ester-modified Cellulose Nanofiber | — | — | — | 3.0% | — | — | — | — | — |
| | Reference | Isopropyl Tri(N-aminoethyl-aminoethyl) Titanate | — | — | — | — | 3.0% | — | — | — | — |
| | Reference | Acetoalkoxy Aluminum Isopropylate | — | — | — | — | — | 3.0% | — | — | — |
| | Reference | Polyoxyethylene Alkyl Ether | — | — | — | — | — | — | 3.0% | — | — |
| | Reference | Polyether Acid, Polyamine | — | — | — | — | — | — | — | 3.0% | — |
| | Reference | Tricresyl Phosphate | — | — | — | | — | — | — | — | 3.0% |
| (b) Base Oil | Mineral Oil | | 90.2% | 90.2% | 90.2% | 90.2% | 91.2% | 91.2% | 90.2% | 90.2% | 91.2% |
| (c) Thickener | Aliphatic Urea Thickener | | 6.8% | 6.8% | 6.8% | 6.8% | — | — | 6.8% | 6.8% | — |
| | Lithium 12-Hydroxystearate | | — | — | — | — | 5.8% | 5.8% | — | — | 5.8% |

TABLE 2-continued

| | | | | | | | | | | | |
|---|---|---|---|---|---|---|---|---|---|---|---|
| Evaluation | Shell ball Test | Last Non-seizure Load (L.N.S.L), N | 981 | 981 | 981 | 490 | 392 | 314 | 490 | 392 | 784 |
| | | Four-Evaluation of Last Non-seizure Load (L.N.S.L) | ○ | ○ | ○ | x | x | x | x | x | x |
| | | Weld Point (W.P.), N | 1236 | 1569 | 1236 | 1236 | 1568 | 1236 | 1236 | 1568 | 1569 |
| | | Evaluation of Weld Point (W.P.) | x | x | x | x | x | x | x | x | x |
| | SRV Test | OK Value, N | 1000 | 1200 | 1200 | — | — | — | — | — | 800 |
| | | Evaluation of OK Value | ○ | ○ | ○ | — | — | — | — | — | x |
| | Worked Penetratio | Worked Penetration | 282 | 258 | 321 | 228 | — | — | — | — | 314 |
| | | Evaluation of Worked Penetration | ○ | ○ | ○ | ○ | — | — | — | — | ○ |

What is claimed is:

1. A grease composition comprising:

(a) a compound having a phosphate ester moiety, (b) a base oil; and (c) a thickener, wherein the last non-seizure load measured in accordance with ASTM D-2596 is 980 N or more, and component (a) is at least one coupling agent (a2) having a phosphate ester moiety within the molecule, selected from the group consisting of (a2-1) silane coupling agents, and (a2-4) zirconate coupling agents.

2. The grease composition according to claim 1, containing component (a) at 0.1 to 20% by mass based on a total mass of the composition.

3. The grease composition according to claim 1, wherein the content of component (a) is 0.1 to 15% by mass based on the total mass of the composition.

* * * * *